US011254117B2

(12) United States Patent
Kamoda et al.

(10) Patent No.: US 11,254,117 B2
(45) Date of Patent: Feb. 22, 2022

(54) PROCESSING DEVICE

(71) Applicant: KOMORI CORPORATION, Tokyo (JP)

(72) Inventors: Hiroyoshi Kamoda, Ibaraki (JP); Naoya Yamashita, Ibaraki (JP)

(73) Assignee: KOMORI CORPORATION, Tokyo (JP)

( * ) Notice: Subject to any disclaimer, the term of this patent is extended or adjusted under 35 U.S.C. 154(b) by 185 days.

(21) Appl. No.: 16/341,393

(22) PCT Filed: Oct. 11, 2017

(86) PCT No.: PCT/JP2017/036789
§ 371 (c)(1),
(2) Date: Apr. 11, 2019

(87) PCT Pub. No.: WO2018/070410
PCT Pub. Date: Apr. 19, 2018

(65) Prior Publication Data

US 2020/0039206 A1 Feb. 6, 2020

(30) Foreign Application Priority Data

Oct. 14, 2016 (JP) ..... JP2016-202295

(51) Int. Cl.
*B41F 19/02* (2006.01)
*B41F 23/08* (2006.01)

(52) U.S. Cl.
CPC ..... *B41F 19/02* (2013.01); *B41F 23/08* (2013.01)

(58) Field of Classification Search
CPC ..... B41F 19/02
(Continued)

(56) References Cited

U.S. PATENT DOCUMENTS 6,302,016 B1 * 10/2001 Fausto ..... B41F 19/062 101/116
6,338,299 B1 1/2002 Kamoda et al.
(Continued)

FOREIGN PATENT DOCUMENTS

CN 1250719 A 4/2000
CN 102029779 A 4/2011
(Continued)

OTHER PUBLICATIONS

Office Action received for Chinese Patent Application No. 201780063048.9, dated Dec. 28, 2020, 11 pages (3 pages of English Translation and 8 pages of Office Action).
(Continued)

*Primary Examiner* — Anthony H Nguyen
(74) *Attorney, Agent, or Firm* — Womble Bond Dickinson (US) LLP

(57) ABSTRACT

A processing device configured to process a printed sheet (3) includes an embossing device (5) configured to perform emboss-processing of the sheet (3), and a final processing device configured to perform final working processing of a surface of the sheet (3). The final processing device includes at least one of a number printing device (6) configured to print a number on the sheet (3), and a varnishing device configured to apply a varnish to the sheet (3). There is provided a processing device capable of performing emboss-processing without disturbing sheet feeding when performing the final process of printing by performing the emboss-processing at an appropriate stage of a printing step.

3 Claims, 7 Drawing Sheets

(58) Field of Classification Search
USPC ..... 101/23
See application file for complete search history.

(56) References Cited

U.S. PATENT DOCUMENTS

| | | | | |
|---|---|---|---|---|
| 6,371,019 | B1 * | 4/2002 | Bosen | B41F 13/30 101/216 |
| 6,443,058 | B1 * | 9/2002 | Stadler | B41F 11/00 101/142 |
| 6,694,872 | B1 * | 2/2004 | LaBelle | B41F 19/02 101/23 |
| 2001/0045167 | A1 * | 11/2001 | Schaum | B41F 13/14 101/248 |
| 2002/0011707 | A1 | 1/2002 | Schaum | |
| 2003/0205153 | A1 * | 11/2003 | Wadlinger | B41F 22/00 101/183 |
| 2005/0284312 | A1 | 12/2005 | Kristel | |
| 2006/0272534 | A1 * | 12/2006 | Lieberman | B41F 19/062 101/487 |
| 2008/0121123 | A1 * | 5/2008 | Gebhardt | B41F 27/12 101/24 |
| 2008/0236411 | A1 * | 10/2008 | Schaum | B41F 19/02 101/23 |
| 2008/0295710 | A1 * | 12/2008 | Ohsawa | B41F 23/0476 101/23 |
| 2010/0199867 | A1 | 8/2010 | Kuhlmeyer et al. | |
| 2011/0146510 | A1 * | 6/2011 | Bolognini | B41M 7/02 101/216 |
| 2013/0213246 | A1 * | 8/2013 | Schaede | B65H 29/042 101/76 |
| 2014/0061976 | A1 * | 3/2014 | Doersam | B29C 59/16 264/479 |
| 2016/0185102 | A1 | 6/2016 | Schaede et al. | |

FOREIGN PATENT DOCUMENTS

| | | | |
|---|---|---|---|
| CN | 102085747 | A | 6/2011 |
| CN | 104718080 | A | 6/2015 |
| CN | 105437749 | A | 3/2016 |
| DE | 19826974 | A1 | 12/1999 |
| DE | 10004997 | A1 | 9/2000 |
| EP | 0624466 | B1 | 4/1997 |
| EP | 1147893 | A2 | 10/2001 |
| EP | 2902201 | A2 | 8/2015 |
| JP | 2000-085096 | A | 3/2000 |
| JP | 2000-103035 | A | 4/2000 |
| JP | 2000-280598 | A | 10/2000 |
| JP | 2007-176044 | A | 7/2007 |
| JP | 2008-528315 | A | 7/2008 |
| JP | 2008-296448 | A | 12/2008 |
| JP | 2010-532724 | A | 10/2010 |
| JP | 2012-516787 | A | 7/2012 |
| JP | 2013-529147 | A | 7/2013 |

OTHER PUBLICATIONS

Office Action received for Japanese Patent Application No. 2018-545016, dated Jun. 2, 2020, 6 pages (3 pages of English Translation and 3 pages of Office Action).

Office Action received for Japanese Patent Application No. 2018-545016, dated Nov. 12, 2019, 8 pages (4 pages of English Translation and 4 pages of Office Action).

Supplementary European search report and Search Opinion received for EP Patent Application No. 17859614.4, dated Apr. 22, 2020, 9 pages.

Office Action received for Japanese Patent Application No. 2018-545016, dated Jan. 12, 2021, 5 pages (2 pages of English Translation and 3 pages of Office Action).

Office Action received for Chinese Patent Application No. 201780063048.9, dated Apr. 23, 2020, 14 pages (7 pages of English Translation and 7 pages of Office Action).

International Preliminary Report on Patentability received for PCT Patent Application No. PCT/JP2017/036789, dated Apr. 25, 2019, 13 pages (8 pages of English Translation and 5 pages of Original Document).

International Search Report and Written Opinion received for PCT Patent Application No. PCT/JP2017/036789, dated Dec. 12, 2017, 18 pages (9 pages of English Translation and 9 pages of Original Document).

Office Action received for Chinese Patent Application No. 201780063048.9, dated May 26, 2021, 16 pages (10 pages of English Translation and 6 pages of Office Action).

Office Action received for Chinese Patent Application No. 201780063048.9, dated Aug. 31, 2021, 20 pages (11 pages of English Translation and 9 pages of Office Action).

Yaocun, Tang, "Printing machine structure, adjustment and operation", Training Materials for Professional Skills Appraisal of Lithographic printing workers, Printing Industry Press, Oct. 2006, 7 pages (3 pages of English Translation and 4 pages of Office Action).

* cited by examiner

PROCESSING DEVICE

TECHNICAL FIELD

The present invention relates to a processing device that performs emboss-processing and final working processing of a sheet as a prospective security.

BACKGROUND ART

Conventionally, a printing press described in, for example, patent literature 1 is used as a device capable of emboss-processing a surface of a sheet. Patent literature 1 shows a sheet-fed offset printing press capable of performing emboss-processing and transfer or printing of a foil.

In a bill formed by a sheet made of a polymer material, there is a demand to provide a convex portion of a different tactile feeling on a printed sheet by emboss-processing to obtain added values such as a forgery preventing technique, consideration for users, and improvement of usability.

RELATED ART LITERATURE

Patent Literature

Patent Literature 1: Japanese Patent Laid-Open No. 2008-296448

DISCLOSURE OF INVENTION

Problem to be Solved by the Invention

A sheet embossed by the printing press described in patent literature 1 is sometimes transferred to another processing machine that performs the final process of printing. The final process of printing is a process of performing certain processing for the surface of a sheet after pattern printing before cutting and folding of the sheet. Examples of the processing are number printing and varnish application.

To perform processing of the final process for a sheet after emboss-processing, a number of sheets after emboss-processing are transferred in a stacked state to a processing machine that executes the processing of the final process.

When a convex portion is provided on each sheet by emboss-processing, the thickness of the sheet partially increases in the embossed portion. When such embossed sheets are stacked, each embossed portion is strongly pressed against another sheet. For this reason, when supplying a sheet in the processing machine that executes the above-described processing of the final process, the embossed portion may be caught by another sheet, resulting in poor sheet feeding.

It is an object of the present invention to provide a processing device capable of performing emboss-processing without disturbing sheet feeding when performing the final process of printing by performing the emboss-processing at an appropriate stage of a printing step after pattern printing is performed and after sheet transfer has ended.

Means of Solution to the Problem

In order to achieve the object, a processing device according to the present invention is a processing device configured to process a printed sheet, comprising an embossing device configured to perform emboss-processing of the sheet, and a final processing device configured to perform final working processing of a surface of the sheet, wherein the final processing device comprises at least one of a number printing device configured to print a number on the sheet, and a varnishing device configured to apply a varnish to the sheet.

Effect of the Invention

In the present invention, since emboss-processing can be performed in the final process of printing, the sheet after emboss-processing is not transferred to another processing machine, and printing or varnish application is not performed for the sheet. It is therefore possible to perform an at a stage after pattern printing is performed and after sheet transfer has ended, that is, at an appropriate stage of the printing step, in which an embossed portion does not exert an adverse effect on pattern printing and sheet feeding.

Hence, according to the present invention, it is possible to provide a processing device capable of performing emboss-processing without disturbing sheet feeding when performing the final process of printing.

BEST MODE FOR CARRYING OUT THE INVENTION

First Embodiment

A processing device according to an embodiment of the present invention will now be described in detail with reference to FIGS. 1 and 2.

Figure 1:
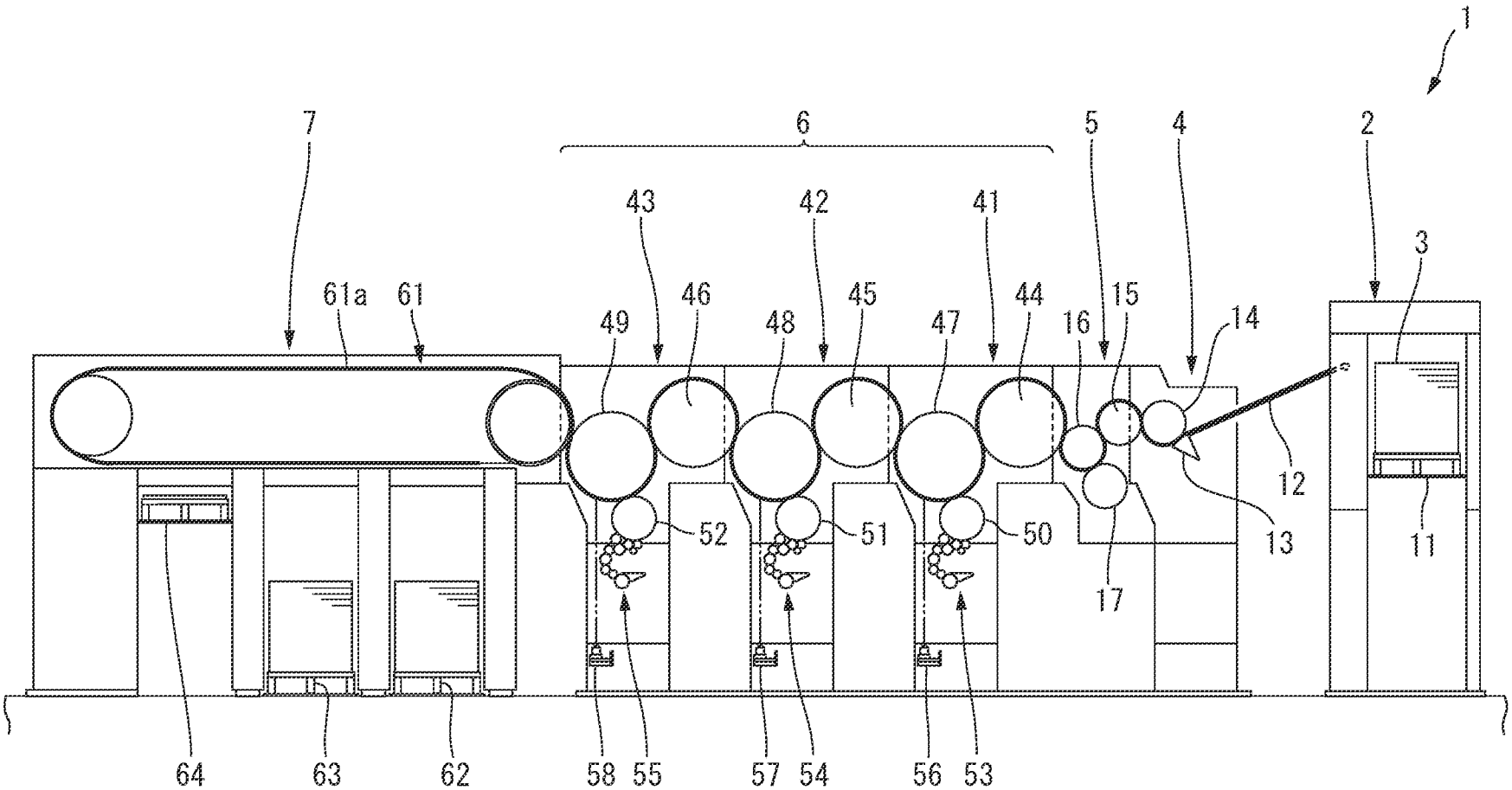
FIG. 1 is a side view showing the arrangement of a processing device according to the first embodiment.
Figure 2:
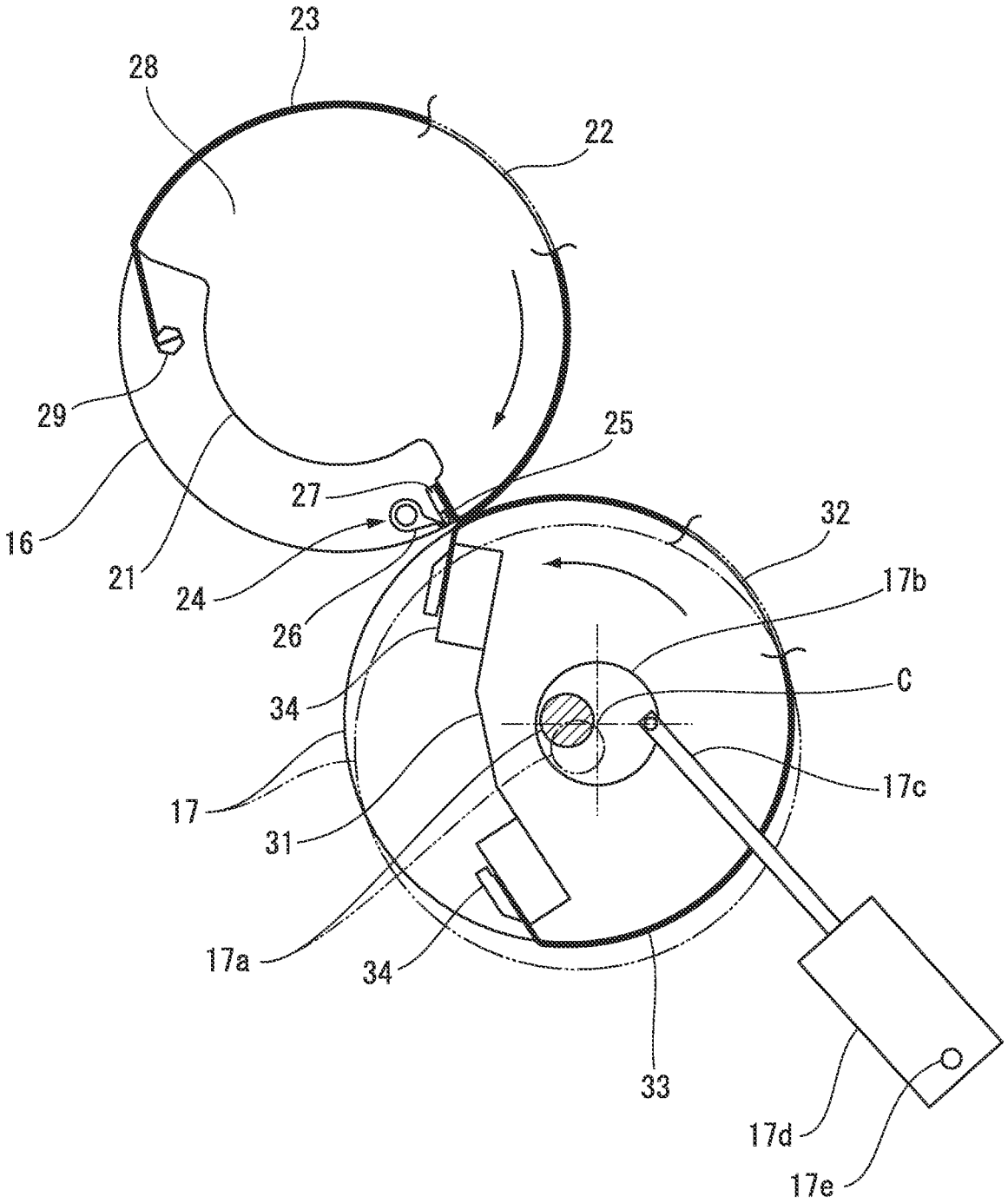
FIG. 2 is a side view showing the arrangement of an embossing unit.

A processing device 1 shown in FIG. 1 is a device configured to perform emboss-processing and final working processing (to be referred to as "final processing" hereinafter) at the final stage of the manufacturing step of securities and the like including bills. "Final processing" here is processing performed for the surface of a sheet after pattern printing before cutting and folding of the sheet. Examples of the final processing are number printing and varnish application.

The processing device 1 is formed by a sheet supply device 2, a loading device 4, an embossing device 5, a number printing device 6, and a sheet discharge device 7. In the processing device 1, a sheet 3 supplied from the sheet supply device 2 located on the rightmost side in FIG. 1 is sent to the sheet discharge device 7 located on the leftmost side in FIG. 1 via the loading device 4, the embossing device 5, and the number printing device 6. In FIG. 1, the conveyance path of the sheet 3 is indicated by a thick line.

The sheet 3 is a sheet that is made of a polymer material as prospective securities including bills and bank notes, which is an intermediate product after pattern printing. Note that the processing device 1 can perform emboss-processing and final processing not only for a sheet made of a polymer material but also for a sheet made of paper.

The sheet supply device 2, the loading device 4, the embossing device 5, the number printing device 6, and the sheet discharge device 7 used in the processing device 1 are unitized as independent devices and combined such that emboss-processing and final processing can continuously be performed for the sheet.

The sheet supply device 2 includes an elevating feeder pile 11 on which a number of sheets 3 are stacked, and a sucker device (not shown) configured to place the sheet 3 located at the uppermost position onto a feeder board 12. On the feeder pile 11, the sheets 3 are stacked in a state in which each sheet has one surface facing upward. In this specification, for the sake of convenience, one surface of the sheet 3 directed upward in a state in which the sheet is stacked on the feeder pile 11 will be referred to as an "upper surface", and the other surface as a "lower surface".

The loading device 4 includes a swing device 13 and a first transfer cylinder 14. The swing device 13 includes a gripper device (not shown) configured to hold an end of the sheet 3, sent by the feeder board 12, on the downstream side in the conveyance direction, and swings between the feeder board 12 and the first transfer cylinder 14. The first transfer cylinder 14 rotates in synchronism with the swing of the swing device 13.

The sheet 3 placed on the feeder board 12 by the sucker device (not shown) is sent to a second transfer cylinder 15 of the embossing device 5 via the swing device 13 and the first transfer cylinder 14 of the loading device 4. Each of the first transfer cylinder 14 and the second transfer cylinder 15 includes a gripper device configured to hold the end of the sheet 3 on the downstream side in the conveyance direction, although not illustrated. Each of the first transfer cylinder 14 and the second transfer cylinder 15 grips and holds the sheet 3 by the gripper device and rotates in the holding state, thereby conveying the sheet 3.

The embossing device 5 includes the above-described second transfer cylinder 15, an embossing impression cylinder 16, and a plate cylinder 17. As shown in FIG. 2, the embossing impression cylinder 16 is a single-diameter cylinder including one notch portion 21 on the outer peripheral portion, and an effective impression area 22 which has an area corresponding to one sheet and in which the notch portion 21 is not provided. The notch portion 21 is formed such that a part of the outer peripheral portion of the embossing impression cylinder 16 obtains a small diameter as compared to the remaining portion. The effective impression area 22 is the outer peripheral surface of the embossing impression cylinder 16 with which the sheet 3 can come into tight contact. In addition, the "area corresponding to one sheet" is an area that allows only one sheet 3 to be wound around it. A first plate 23 for emboss-processing is wound around the effective impression area 22. The first plate 23 is in contact with the upper surface of the sheet 3.

A gripper device 24 configured to grip and hold the end of the sheet 3 on the downstream side in the conveyance direction is provided at the upstream-side end of the embossing impression cylinder 16 in the rotation direction (clockwise in FIG. 2) in the notch portion 21. The gripper device 24 includes a gripper pad 25, and grippers 26 that swing with respect to the gripper pad 25. In this embodiment, the gripper device 24 corresponds to a "sheet holding device" in the present invention.

The gripper pad 25 is attached to the distal end of a gripper pad bar 27. The gripper pad bar 27 is attached to an impression cylinder main body 28 so as to be swingable with respect to an axis parallel to the axis of the embossing impression cylinder 16 as the center. The gripper pad bar 27 has a function of holding one end of the first plate 23 in cooperation with the impression cylinder main body 28. The other end of the first plate 23 is attached to the downstream-side end of the embossing impression cylinder 16 in the rotation direction in the notch portion 21, that is, a winding member 29 provided at an end on the side opposite to the gripper pad 25.

The first plate 23 has one end fixed to the impression cylinder main body 28 by the gripper pad bar 27 and the other end wound by the winding member 29, and is thus held on the embossing impression cylinder 16 while being wound on the effective impression area 22. In this embodiment, the gripper pad bar 27 and the winding member 29 correspond to a "first plate holding device" in the present invention. The gripper pad bar 27 and the winding member 29 are capable of holding both an intaglio printing plate and a relief printing plate.

The plate cylinder 17 is a single-diameter cylinder including one notch portion 31 on the outer peripheral portion, and an effective impression area 32 which has an area corresponding to one sheet and in which the notch portion 31 is not provided. Additionally, as shown in FIG. 2, the plate cylinder 17 includes a support shaft 17*a* in the axial portion. The support shaft 17*a* is rotatably supported by a frame (not shown) via an eccentric bearing 17*b*. The eccentric bearing 17*b* is pivotally supported by the frame, and rotatably supports the support shaft 17*a* at a position eccentric from an axis C. The plate cylinder 17 rotates about the support shaft 17*a*.

Although not illustrated, a flange is provided on the outer peripheral portion of the eccentric bearing 17*b*. One end of a rod-shaped arm 17*c* is pivotally connected to the flange. A stepping motor 17*d* is connected to the other end of the arm 17*c*. The base end of the stepping motor 17*d* is swingably supported by the frame if a support shaft 17*e*.

That is, when the stepping motor 17*d* is operated to move the arm 17*c* in the axial direction, the eccentric bearing 17*b* pivots. When the eccentric bearing 17*b* pivots, the support shaft 17*a* moves along a virtual circle with respect to the axis C of the eccentric bearing 17 as the center. That is, along with the pivotal movement of the eccentric bearing 17*b*, the plate cylinder 17 moves between a position at which the plate cylinder 17 contacts the embossing impression cylinder 16, as indicated by a solid line in FIG. 2, and a position at which the plate cylinder 17 separates from the impression cylinder 16, as indicated by an alternate long and two short dashed line in FIG. 2. A second plate 33 for emboss-processing is wound on the effective impression area 32 of the plate cylinder 17. The second plate 33 is in contact with the lower surface of the sheet 3.

Plate clamps 34 are provided, respectively, at two ends of the plate cylinder 17 in the rotation direction in the notch portion 31 of the plate cylinder 17. The plate clamps 34 hold one end and the other end of the second plate 33 while pulling the second plate 33 in directions along the peripheral surface of the plate cylinder 17. The second plate 33 has the two ends pulled by the plate clamps 34, and is thus held on the plate cylinder 17 while being wound on the effective impression area 32 of the plate cylinder 17. In this embodiment, the pair of plate clamps 34 corresponds to a "second plate holding device" in the present invention.

The plate clamps 34 are capable of holding both an intaglio printing plate and a relief printing plate. When the first plate 23 formed by an intaglio printing plate is attached to the embossing impression cylinder 16, the second plate 33 formed by a relief printing plate is attached to the plate cylinder 17.

The positioning of the first plate 23 and the second plate 33 in the rotation direction can be performed by shifting the position of the second plate 33 in the rotation direction of the plate cylinder 17 using the plate clamps 34.

The number printing device 6 is formed by first to third number printing units 41 to 43. As shown in FIG. 1, the first to third number printing units 41 to 43 are arranged in a cascade so as to form the conveyance path of the sheet 3. In this embodiment, the number printing device 6 corresponds to a "final processing device" in the present invention.

In this embodiment, units whose structures are identical to each other are used as the first to third number printing units 41 to 43.

The number printing device 6 according to this embodiment includes third to fifth transfer cylinders 44 to 46, first to third number printing impression cylinders 47 to 49, first to third number cylinders 50 to 52, first to third ink supply devices 53 to 55, first to third inspection cameras 56 to 58, and the like in correspondence with the number printing units. Each of the third to fifth transfer cylinders 44 to 46 and the first to third number printing impression cylinders 47 to 49 includes a gripper device configured to hold the end of the sheet 3 on the downstream side in the conveyance direction, although not illustrated. Each of the first to third number printing impression cylinders 47 to 49 comes into contact with the upper surface of the sheet 3.

The third transfer cylinder 44 receives the sheet 3 from the embossing impression cylinder 16 of the embossing device 5 and sends it to the first number printing impression cylinder 47.

The fourth transfer cylinder 45 receives the sheet 3 from the first number printing impression cylinder 47 and sends it to the second number printing impression cylinder 48.

The fifth transfer cylinder 46 receives the sheet 3 from the second number printing impression cylinder 48 and sends it to the third number printing impression cylinder 49.

The first to third number cylinders 50 to 52 each include a numbering device (not shown) configured to print a serial number, and contact the lower portions of the first to third number printing impression cylinders 47 to 49, respectively. Each numbering device prints a number on the lower surface of the sheet 3 conveyed by a corresponding one of the first to third number printing impression cylinders 47 to 49.

The first to third ink supply devices 53 to 55 supply inks to the first to third numbering devices 50 to 52, respectively.

The first to third inspection cameras 56 to 58 are configured to determine the quality of number printing performed by the first to third number printing units 41 to 43, and capture the sheet 3 after number printing, which is conveyed by the first to third number printing impression cylinders 47 to 49, from the lower side. The quality determination is performed based on images captured by the first to third inspection cameras 56 to 58.

The sheet discharge device 7 includes a chain-type conveyance device 61 adjacent to the third number printing impression cylinder 49, and first to third delivery piles 62 to 64. The conveyance device 61 includes a pair of delivery chains 61*a* arranged in the axial direction of the third number printing impression cylinder 49, a number of gripper bars (not shown) bridged between the delivery chains 61*a*, gripper devices (not shown) provided on the gripper bars, and the like.

The sheets 3 conveyed by the conveyance device 61 are classified into non-defective products and defective products based on the result of inspection performed using the first to third inspection cameras 56 to 58 and distributed to the first to third delivery piles 62 to 64. The sheets 3 determined as non-defective products by the quality determination are stacked on the first and second delivery piles 62 and 63, and the sheets 3 determined as defective products are stacked on the third delivery pile 64.

In the thus configured processing device 1, the embossing device 5 performs emboss-processing of the sheet 3 that has undergone pattern printing, and after that, the number printing device 6 performs number printing on the sheet 3. For this reason, when the processing device 1 is used, emboss-processing can be performed in the final process of printing of a security and the like, including a bill. Hence, the sheet after emboss-processing is not transferred to another processing machine, and printing or varnish application is not performed for the sheet.

According to this embodiment, emboss-processing can be performed at a stage after pattern printing is performed and after sheet transfer has ended, that is, at an appropriate stage of the printing step, in which an embossed portion does not exert an adverse effect on pattern printing and sheet feeding.

It is therefore possible to provide a processing device capable of performing emboss-processing without disturbing sheet feeding when performing the final process of printing.

The embossing device 5 according to this embodiment includes the single-diameter embossing impression cylinder 16 including the effective impression area 22 corresponding to one sheet, and the single-diameter plate cylinder 17 configured to be able to contact/separate from the impression cylinder 16 and including the effective impression area 32 corresponding to one sheet. The embossing impression cylinder 16 includes the gripper device (sheet holding device) configured to hold the sheet 3, and the gripper pad bar 27 and the winding member 29 (first plate holding device) configured to hold the first plate 23. The plate cylinder 17 includes the plate clamps 34 (second plate holding device) configured to hold the second plate 33.

As for emboss-processing quality, it is necessary to ensure durability in plastic deformation, prevent tearing in plastic deformation, and obtain a distinct convex shape and an excellent tactile sense. According to this embodiment, since each of the embossing impression cylinder 16 and the plate cylinder 17 is formed by a single-diameter cylinder, the first plate 23 and the second plate 33 have a one-to-one relationship, and the positions of concave and convex patterns match in each rotation, thereby meeting the requirement. In addition, since the impression cylinder 16 and the plate cylinder 17 are single-diameter cylinders, the position adjustment between the first plate 23 and the second plate 33 is easy. Hence, according to this embodiment, it is possible to provide a processing device that ensures high emboss-processing quality.

The gripper pad bar 27 and the winding member 29 (first plate holding device) of the embossing impression cylinder 16 according to this embodiment and the plate clamps 34 (second plate holding device) of the plate cylinder 17 are capable of holding both an intaglio printing plate and a relief printing plate. Emboss-processing is a function of enabling security type determination by a tactile sense. Basically, convex embossing can exist on either of the obverse and reverse sides of the sheet 3 such as a bank note without any problem with the tactile sense. However, which side should have the emboss-processing needs to be decided from the viewpoint of design. In other words, a processing device configured to perform emboss-processing on a bank note is required to have a function of performing emboss-processing on either of the obverse and reverse sides in accordance with the design. According to this embodiment, since an intaglio printing plate surface and a relief printing plate surface can be attached to both cylinders (the impression cylinder 16 and the plate cylinder 17), it is possible to provide a processing device having a high degree of freedom for a bank note design.

Second Embodiment

Figure 3:
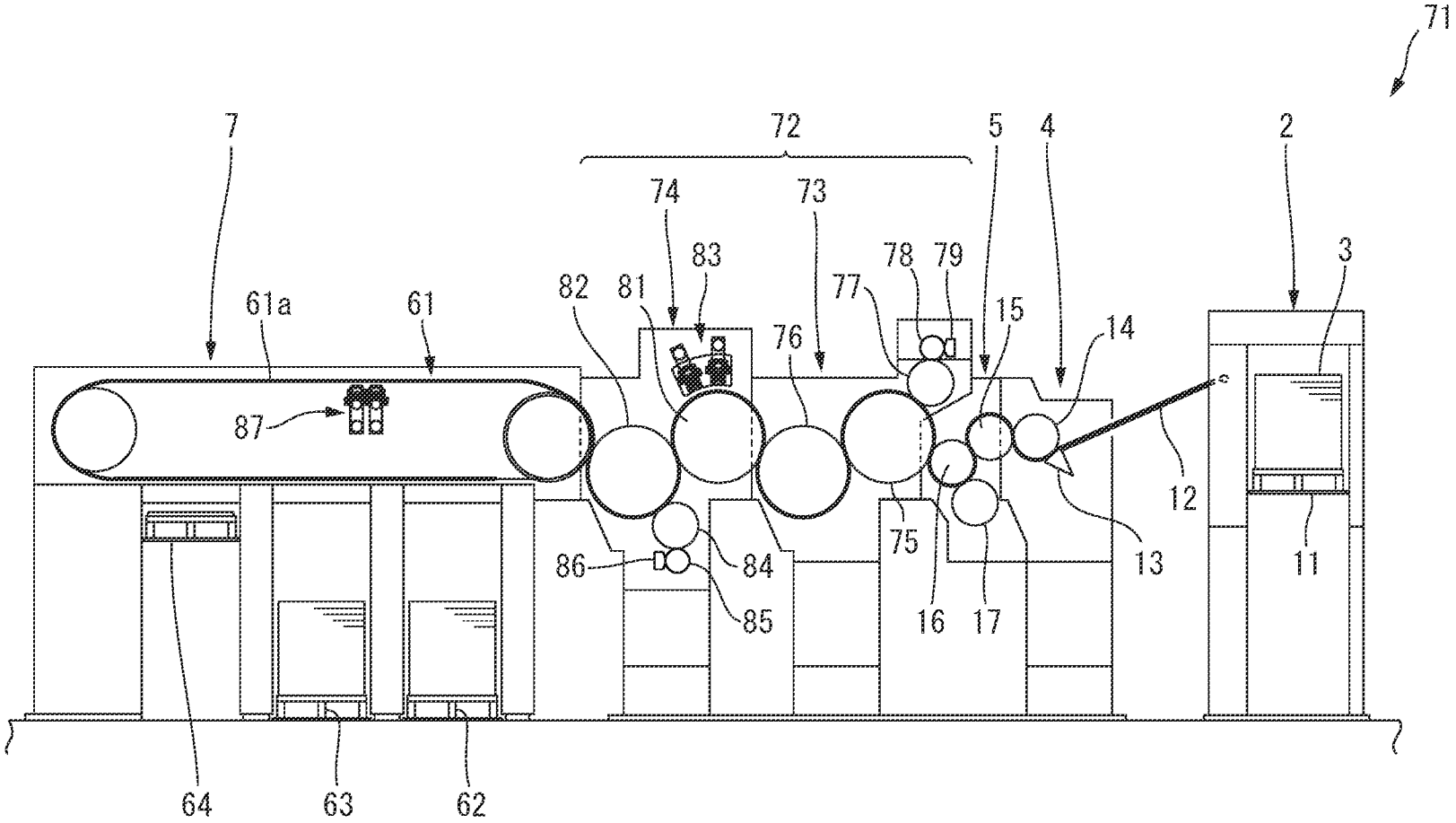
FIG. 3 is a side view showing the arrangement of a processing device according to the second embodiment.

A processing device according to the present invention can be configured as shown in FIG. 3. The same reference numerals as in FIGS. 1 and 2 denote the same or similar members in FIG. 3, and a detailed description thereof will appropriately be omitted.

A processing device 71 shown in FIG. 3 is different from the processing device 1 shown in FIG. 1 in the final processing device, and the rest is the same. Hence, a detailed description of a sheet supply device 2, a loading device 4, an embossing device 5, and a sheet discharge device 7 of the processing device 71 will be omitted.

The final processing device according to this embodiment is a varnishing device 72. The varnishing device 72 includes a first varnishing unit 73 configured to apply a varnish to the upper surface of a sheet 3, and a second varnishing unit 74 configured to apply a varnish to the lower surface of the sheet 3.

The first varnishing unit 73 includes a first varnishing impression cylinder 75 and a skeleton cylinder 76, which form a part of the conveyance path of the sheet 3. The first varnishing impression cylinder 75 is arranged between an embossing impression cylinder 16 and the skeleton cylinder 76 at a position adjacent to the embossing impression cylinder 16. The first varnishing impression cylinder 75 and the skeleton cylinder 76 are rotatably supported by the frame (not shown) of the first varnishing unit 73. Additionally, although not illustrated, each of the first varnishing impression cylinder 75 and the skeleton cylinder 76 includes a gripper device configured to hold an end of the sheet 3 on the downstream side in the conveyance direction. The first varnishing impression cylinder 75 receives the sheet 3 from the embossing impression cylinder 16 of the embossing device 5 and conveys it. The lower surface of the sheet 3 comes into contact with the first varnishing impression cylinder 75. The skeleton cylinder 76 receives the sheet 3 from the impression cylinder 75 and sends it to the second varnishing unit 74. A first varnishing plate cylinder 77 contacts the upper portion of the first varnishing impression cylinder 75. A first anilox roller 78 contacts the upper portion of the first varnishing plate cylinder 77. A first chamber device 79 configured to supply a varnish is connected to the first anilox roller 78. The varnish is an ultraviolet curing varnish.

The second varnishing unit 74 includes a drying cylinder 81 and a second varnishing impression cylinder 82, which form a part of the conveyance path of the sheet 3. The drying cylinder 81 is arranged between the skeleton cylinder 76 and the second varnishing impression cylinder 82 at a position adjacent to the skeleton cylinder 76. The drying cylinder 81 and the second varnishing impression cylinder 82 are rotatably supported by the frame (not shown) of the second varnishing unit 74. Additionally, although not illustrated, each of the drying cylinder 81 and the impression cylinder 82 includes a gripper device configured to hold the end of the sheet 3 on the downstream side in the conveyance direction. The drying cylinder 81 receives the sheet 3 from the skeleton cylinder 76 and conveys it. A first drying device 83 is provided near the upper portion of the drying cylinder 81. The first drying device 83 dries (solidifies) the varnish applied to the sheet 3 by the first varnishing unit 73. The first drying device 83 according to this embodiment irradiates the upper surface of the sheet 3 conveyed by the drying cylinder 81 with ultraviolet rays.

The second varnishing impression cylinder 82 receives the sheet 3 from the drying cylinder 81 and transfers it to a conveyance device 61 of the sheet discharge device 7. A second varnishing plate cylinder 84 contacts the lower portion of the impression cylinder 82. A second anilox roller 85 contacts the lower portion of the second varnishing plate cylinder 84. A second chamber device 86 configured to supply a varnish is connected to the second anilox roller 85. The varnish is an ultraviolet curing varnish.

The varnish applied to the lower surface of the sheet 3 by the second varnishing unit 74 is dried (solidified) by a second drying device 87 provided in the sheet discharge device 7. The second drying device 87 is arranged under the sheet 3 conveyed by the conveyance device 61 and irradiates the lower surface of the sheet 3 with ultraviolet rays.

In the processing device 71 according to this embodiment, the embossing device 5 performs emboss-processing of the sheet 3 that has undergone pattern printing, and after that, the varnishing device 72 performs varnishing processing for the sheet 3. For this reason, when the processing device 71 is used, emboss-processing can be performed in the final process of printing of a security and the like, including a bill. Hence, the sheet after emboss-processing is not transferred to another processing machine, and varnishing processing is not further performed for the sheet. It is therefore possible to perform emboss-processing without disturbing sheet feeding when performing the final process of printing.

Third Embodiment

Figure 4:
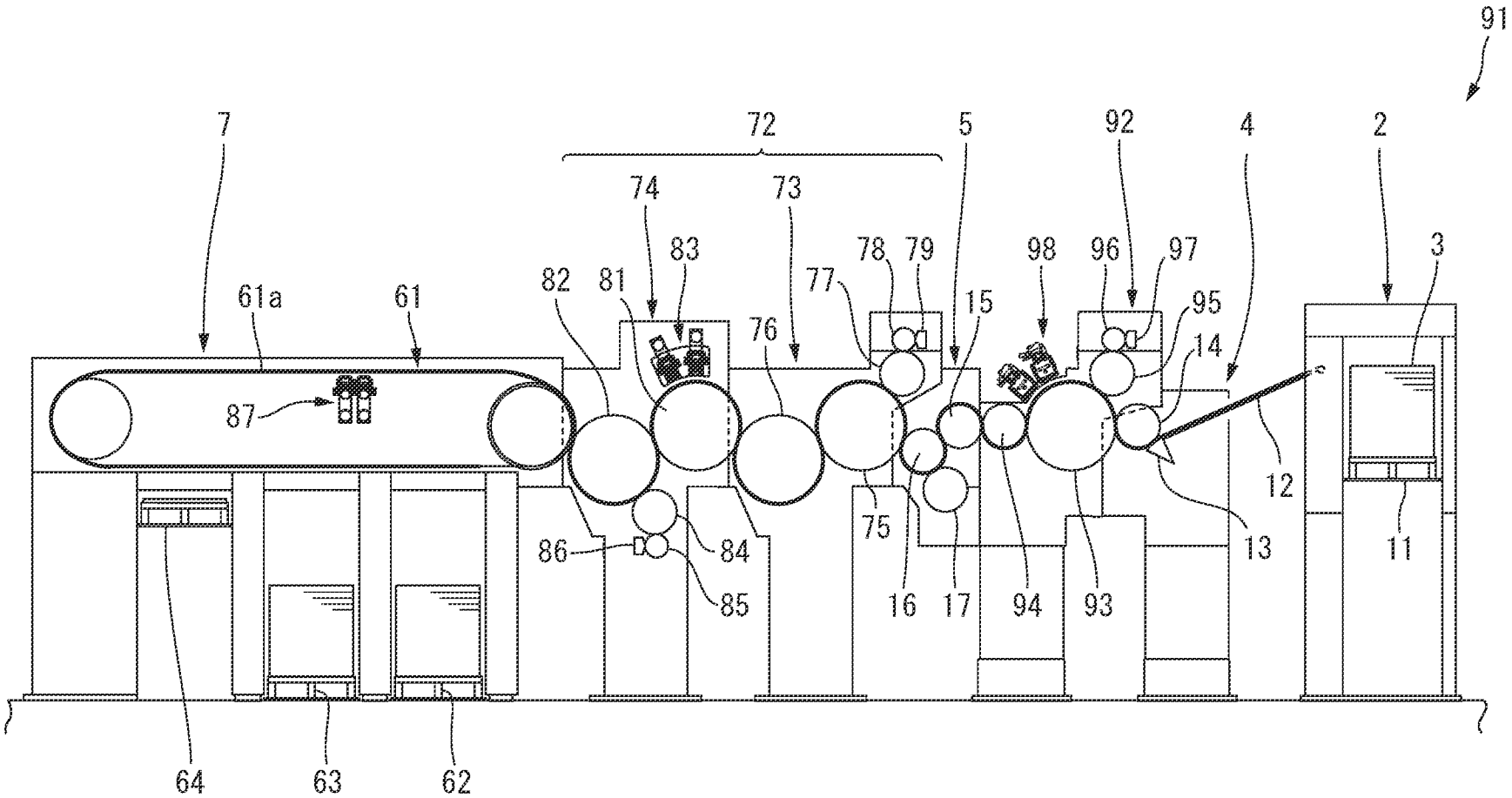
FIG. 4 is a side view showing the arrangement of a processing device according to the third embodiment.

A processing device according to the present invention can be configured as shown in FIG. 4. The same reference numerals as in FIGS. 1 to 3 denote the same or similar members in FIG. 4, and a detailed description thereof will appropriately be omitted.

A processing device 91 shown in FIG. 4 is different from the processing device 71 shown in FIG. 3 in the arrangement between a loading device 4 and an embossing device 5, and the rest is the same. Hence, a detailed description of a sheet supply device 2, the loading device 4, the embossing device 5, a varnishing device 72, and a sheet discharge device 7 of the processing device 91 will be omitted.

An upstream-side varnishing device 92 that forms a part of a "final processing device" in the present invention is provided between the loading device 4 and the embossing device 5. The upstream-side varnishing device 92 applies a varnish to the upper surface of a sheet 3, and includes a third varnishing impression cylinder 93 and a sixth transfer cylinder 94, which form a part of the conveyance path of the sheet 3. Although not illustrated, each of the impression cylinder 93 and the sixth transfer cylinder 94 includes a gripper device configured to hold an end of the sheet 3 on the downstream side in the conveyance direction.

The third varnishing impression cylinder 93 receives the sheet 3 from a first transfer cylinder 14 of the loading device 4 and conveys it. The lower surface of the sheet 3 comes into contact with the impression cylinder 93. The sixth transfer cylinder 94 receives the sheet 3 from the impression cylinder 93 and sends it to a second transfer cylinder 15 of the embossing device 5.

A third varnishing plate cylinder 95 contacts the upper portion of the third varnishing impression cylinder 93. A third anilox roller 96 contacts the upper portion of the third varnishing plate cylinder 95.

A third chamber device 97 configured to supply a varnish is connected to the third anilox roller 96. The varnish is an ultraviolet curing varnish. After the application to the sheet 3, the varnish is dried (solidified) by a third drying device 98 in the middle of the conveyance of the sheet 3 by the impression cylinder 93. The third drying device 98 is arranged near the upper portion of the third varnishing impression cylinder 93, and irradiates the upper surface of the sheet 3 conveyed by the impression cylinder 93 with ultraviolet rays.

In the processing device 91 according to this embodiment, the upstream-side varnishing device 92 applies a varnish to the upper surface of the sheet 3 that has undergone pattern printing, and after that, the embossing device 5 performs emboss-processing. After the emboss-processing, the varnishing device 72 on the downstream side applies a varnish to each of the upper surface and the lower surface of the sheet 3, thereby completing a product. For this reason, in the processing device 91 as well, emboss-processing can be performed in the final process of printing of a security and the like, including a bill. Hence, the sheet after emboss-processing is not transferred to another processing machine, and processing such as printing or varnish application is not further performed for the sheet. It is therefore possible to perform emboss-processing without disturbing sheet feeding when performing the final process of printing.

Fourth Embodiment

Figure 5:
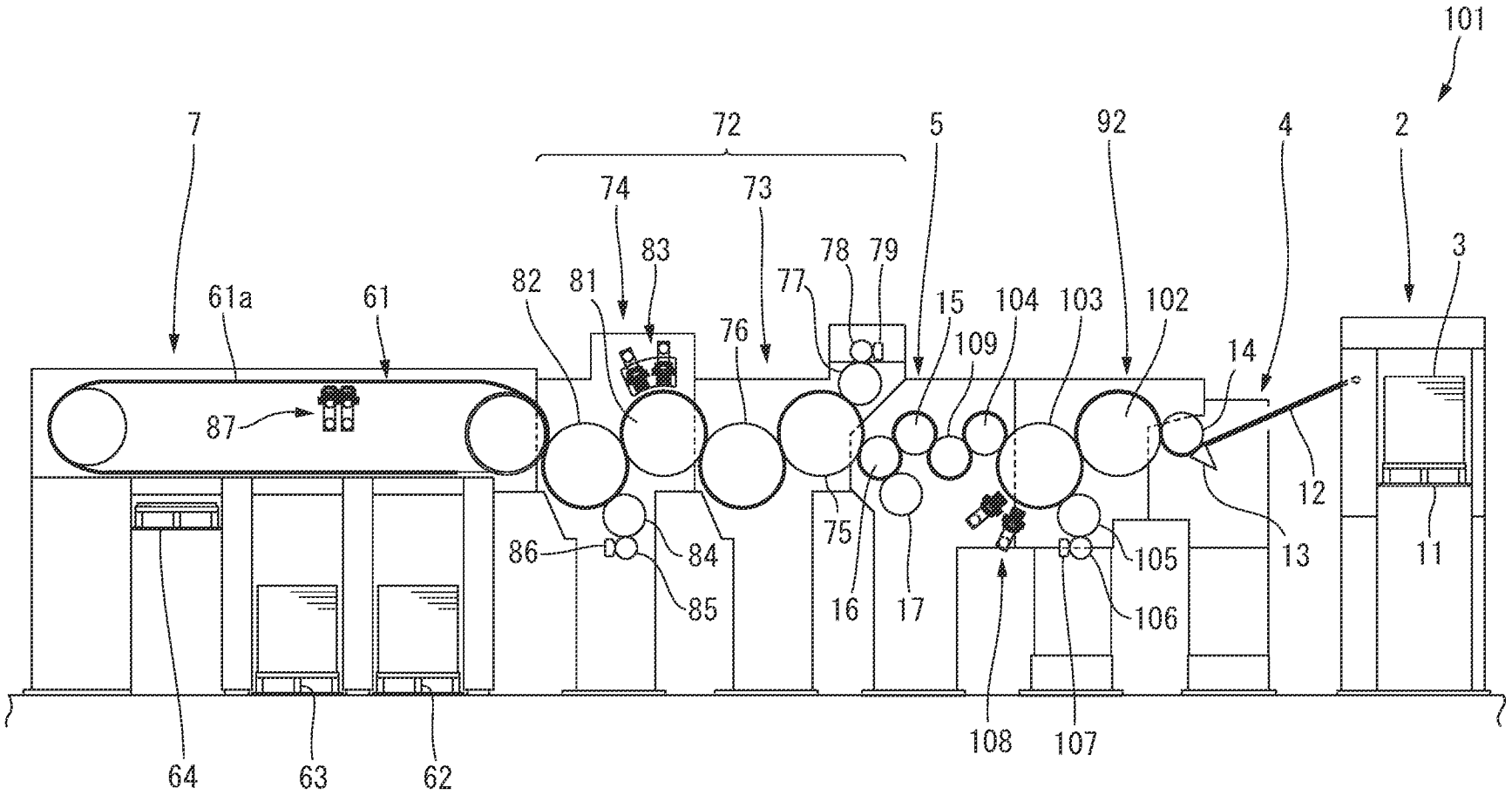
FIG. 5 is a side view showing the arrangement of a processing device according to the fourth embodiment.

A processing device according to the present invention can be configured as shown in FIG. 5. The same reference numerals as in FIGS. 1 to 4 denote the same or similar members in FIG. 5, and a detailed description thereof will appropriately be omitted.

A processing device 101 shown in FIG. 5 is different from the processing device 91 shown in FIG. 4 in the arrangements of an upstream-side varnishing device 92 and the upstream portion of an embossing device 5, and the rest is the same. Hence, a detailed description of a sheet supply device 2, a loading device 4, the downstream portion of the embossing device 5 as the main portion, a varnishing device 72, and a sheet discharge device 7 of the processing device 101 will be omitted.

The upstream-side varnishing device 92 according to this embodiment applies a varnish to the lower surface of a sheet 3, and includes a seventh transfer cylinder 102 and a fourth varnishing impression cylinder 103, which form a part of the conveyance path of the sheet 3. Although not illustrated, each of the seventh transfer cylinder 102 and the impression cylinder 103 includes a gripper device configured to hold an end of the sheet 3 on the downstream side in the conveyance direction. The seventh transfer cylinder 102 receives the sheet 3 from a first transfer cylinder 14 of the loading device 4 and conveys it. The fourth varnishing impression cylinder 103 receives the sheet 3 from the seventh transfer cylinder 102 and sends it to an eighth transfer cylinder 104 provided in the upper portion of the embossing device 5.

The fourth varnishing impression cylinder 103 is in contact with the upper surface of the sheet 3. In addition, a fourth varnishing plate cylinder 105 contacts the lower portion of the fourth varnishing impression cylinder 103. A fourth anilox roller 106 contacts the fourth varnishing plate cylinder 105. A fourth chamber device 107 configured to supply a varnish is connected to the fourth anilox roller 106. The varnish is an ultraviolet curing varnish. After the application to the sheet 3, the varnish is dried (solidified) by a fourth drying device 108 in the middle of the conveyance of the sheet 3 by the fourth varnishing impression cylinder 103. The fourth drying device 108 is arranged near the lower portion of the fourth varnishing impression cylinder 103, and irradiates the lower surface of the sheet 3 conveyed by the impression cylinder 103 with ultraviolet rays.

The eighth transfer cylinder 104 and a ninth transfer cylinder 109 are provided in the upstream portion of the embossing device 5 according to this embodiment. Although not illustrated, each of the eighth transfer cylinder 104 and the ninth transfer cylinder 109 includes a gripper device configured to hold the end of the sheet 3 on the downstream side in the conveyance direction. The sheet 3 to which the varnish is applied by the upstream-side varnishing device 92 is sent from the fourth varnishing impression cylinder 103 to a second transfer cylinder 15 in the downstream portion of the embossing device 5 via the eighth transfer cylinder 104 and the ninth transfer cylinder 109. The downstream portion of the embossing device 5 is formed by the second transfer cylinder 15, an embossing impression cylinder 16, and a plate cylinder 17.

In the processing device 101 according to this embodiment, the upstream-side varnishing device 92 applies a varnish to the lower surface of the sheet 3 that has undergone pattern printing, and after that, the embossing device 5 performs embossing. After the emboss-processing, the varnishing device 72 on the downstream side applies a varnish to each of the upper surface and the lower surface of the sheet 3. For this reason, in the processing device 101 as well, emboss-processing can be performed in the final process of printing of a security and the like, including a bill. Hence, the sheet after emboss-processing is not transferred to another processing machine, and processing such as printing or varnish application is not further performed for the sheet. It is therefore possible to perform emboss-processing without disturbing sheet feeding when performing the final process of printing.

Fifth Embodiment

Figure 6:
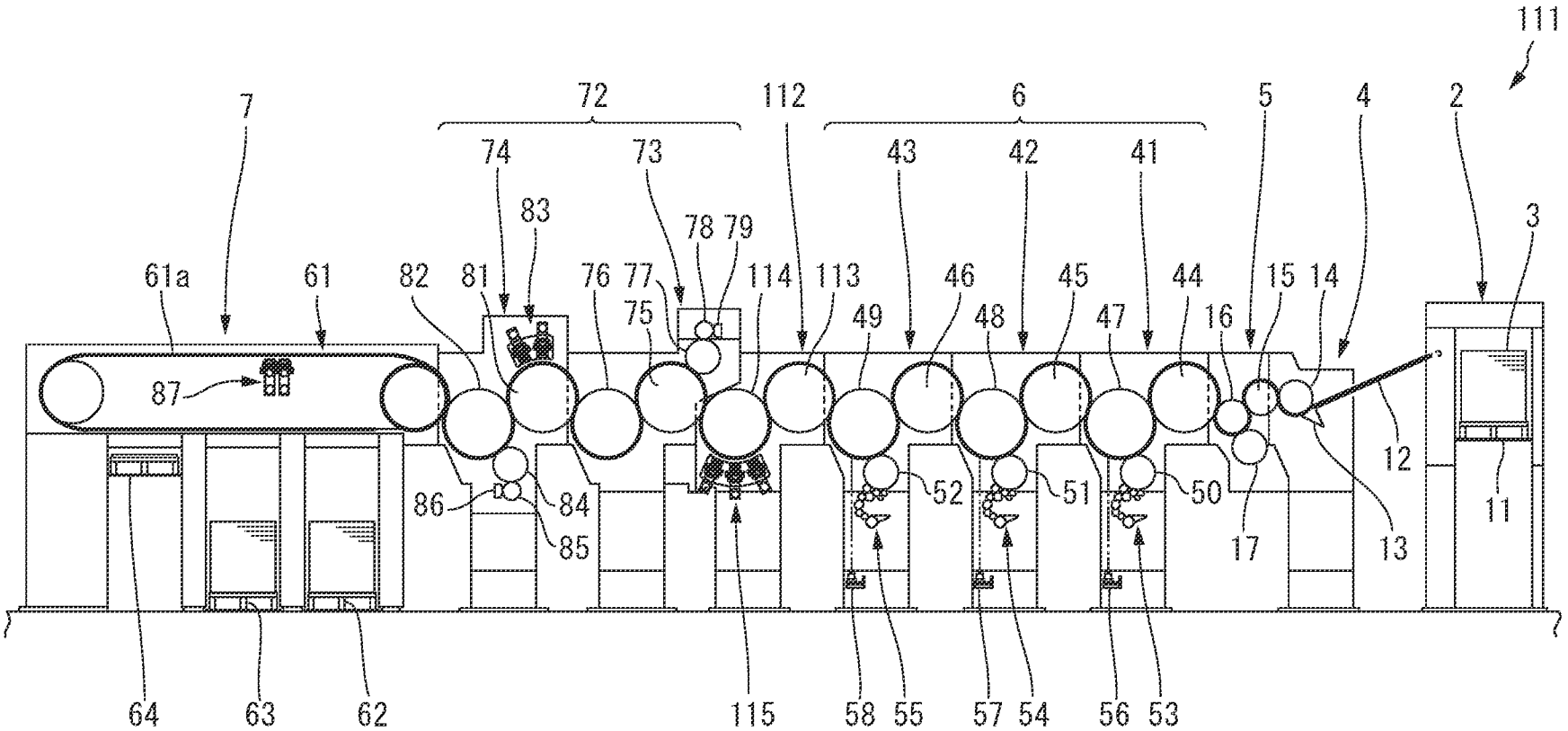
FIG. 6 is a side view showing the arrangement of a processing device according to the fifth embodiment.

A processing device according to the present invention can be configured as shown in FIG. 6. The same reference numerals as in FIGS. 1 to 5 denote the same or similar members in FIG. 6, and a detailed description thereof will appropriately be omitted.

In a processing device 111 shown in FIG. 6, a drying unit 112 and a varnishing device 72 shown in FIG. 3 are added between a number printing device 6 and a sheet discharge device 7 of a processing device 1 shown in FIG. 1. Hence, a detailed description of a sheet supply device 2, a loading device 4, an embossing device 5, the number printing device 6, the varnishing device 72, and the sheet discharge device 7 of the processing device 111 will be omitted. In the processing device 111, the number printing device 6 and the varnishing device 72 correspond to a "final processing device" in the present invention.

The drying unit 112 forms a part of the number printing device 6, and includes a 10th transfer cylinder 113 and a drying cylinder 114, which form a part of the conveyance path of a sheet 3. Although not illustrated, each of the 10th transfer cylinder 113 and the drying cylinder 114 includes a gripper device configured to hold an end of the sheet 3 on the downstream side in the conveyance direction. The 10th transfer cylinder 113 receives the sheet 3 from a third number printing impression cylinder 49 and conveys it. The drying cylinder 114 receives the sheet 3 from the 10th transfer cylinder 113 and sends it to a first varnishing impression cylinder 75 of the varnishing device 72. A drying device 115 is arranged near the lower portion of the drying cylinder 114. The drying device 115 irradiates the lower surface of the sheet 3 conveyed by the drying cylinder 114 with ultraviolet rays, and dries (solidifies) inks printed on the sheet 3 by first to third number printing units 41 to 43.

In the processing device 111 according to this embodiment, the embossing device 5 performs emboss-processing of the sheet 3 that has undergone pattern printing, and after that, the number printing device 6 prints numbers on the lower surface of the sheet 3. After the inks of number printing are solidified, the varnishing device 72 applies a varnish to both surfaces of the sheet 3. For this reason, in the processing device 111 as well, emboss-processing can be performed in the final process of printing of a security and the like, including a bill. Hence, the sheet after emboss-processing is not transferred to another processing machine, and processing such as printing or varnish application is not further performed for the sheet. It is therefore possible to perform emboss-processing without disturbing sheet feeding when performing the final process of printing.

Sixth Embodiment

Figure 7:
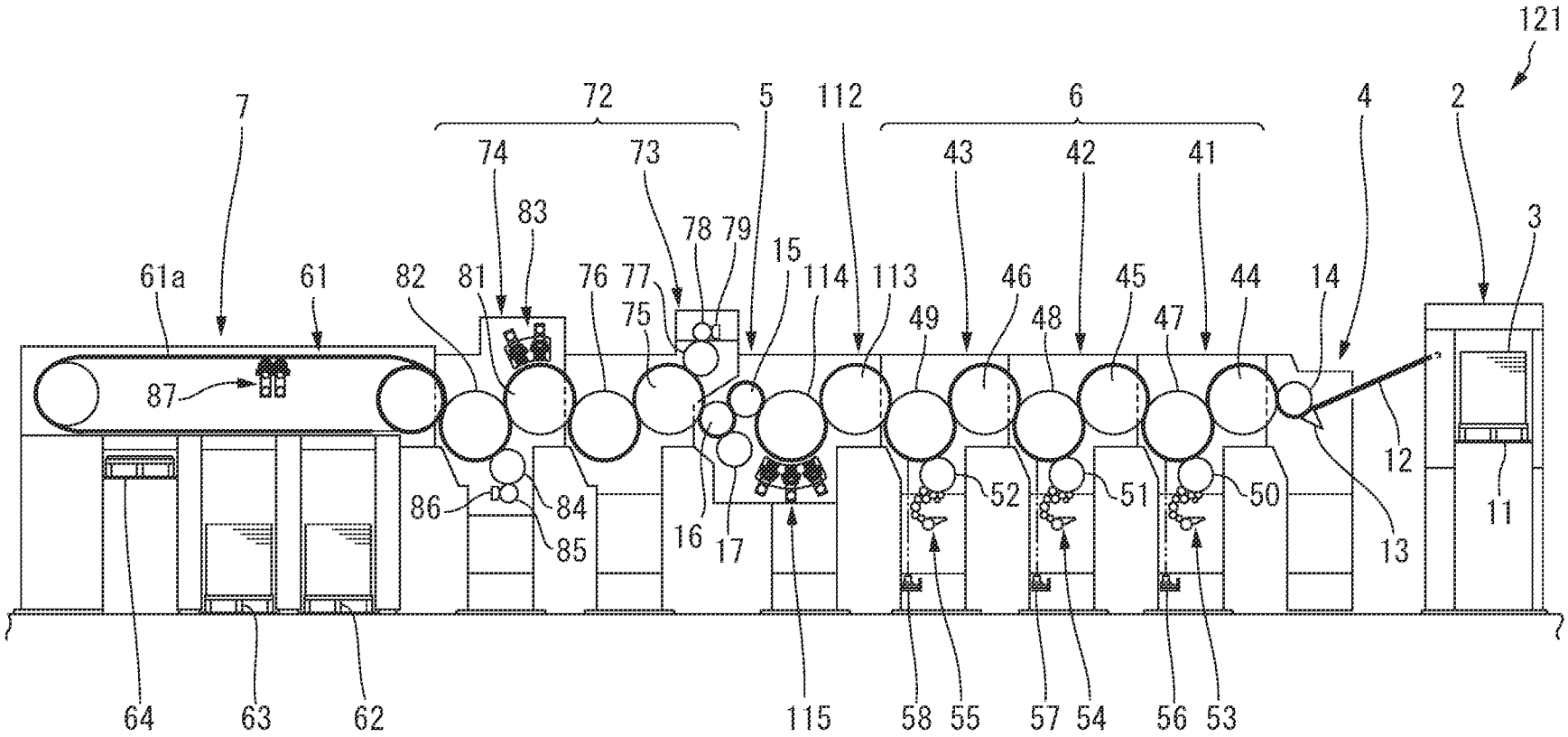
FIG. 7 is a side view showing the arrangement of a processing device according to the sixth embodiment.

A processing device according to the present invention can be configured as shown in FIG. 7. The same reference numerals as in FIGS. 1 to 6 denote the same or similar members in FIG. 7, and a detailed description thereof will appropriately be omitted.

A processing device 121 shown in FIG. 7 is different from the processing device shown in FIG. 6 in the position of an embossing device 5, and the rest is the same.

The embossing device 5 according to this embodiment is provided between a varnishing device 72 and a drying cylinder 114 of a number printing device 6.

A second transfer cylinder 15 of the embossing device 5 receives a sheet 3 from the drying cylinder 114 of the number printing device 6 and sends it to an embossing impression cylinder 16. In addition, the sheet 3 after emboss-processing is sent from the embossing impression cylinder 16 to a first varnishing impression cylinder 75 of the varnishing device 72.

For this reason, in the processing device 121 according to this embodiment, the number printing device 6 prints numbers on the lower surface of the sheet 3 that has undergone pattern printing, after that, the embossing device 5 performs emboss-processing, and the varnishing device 72 applies a varnish to both surfaces of the sheet 3. Hence, in the processing device 121 as well, emboss-processing can be performed in the final process of printing of a security and the like, including a bill. Hence, the sheet after emboss-processing is not transferred to another processing machine, and processing such as printing or varnish application is not further performed for the sheet. It is therefore possible to perform emboss-processing without disturbing sheet feeding when performing the final process of printing.

EXPLANATION OF THE REFERENCE NUMERALS AND SIGNS

1, 71, 91, 101, 111, 121 . . . processing device, 3 . . . sheet, 5 . . . embossing device, 6 . . . number printing device, 16 . . . embossing impression cylinder, 17 . . . plate cylinder, 24 . . . gripper device (sheet holding device), 27 . . . gripper pad bar (first plate holding device), 29 . . . winding member (first plate holding device), 34 . . . plate clamp (second plate holding device), 72 . . . varnishing device, 92 . . . upstream-side varnishing device 92.

The invention claimed is:

1. A processing device configured to process a printed sheet, comprising:

an embossing device including an embossing impression cylinder and a plate cylinder and configured to perform emboss-processing of the sheet; and a final processing device configured to perform final working processing of a surface of the sheet, wherein the final processing device comprises a varnishing device arranged downstream of the embossing device and configured to apply a varnish to both surfaces of the sheet, wherein the varnishing device includes a first varnishing impression cylinder which is adjacent to the embossing impression cylinder and is configured to receive the sheet directly from the embossing impression cylinder;

a second varnishing impression cylinder; and a skeleton cylinder which is arranged between the first varnishing impression cylinder and the second varnishing impression cylinder and is configured to receive the sheet from the first varnishing impression cylinder.

2. The processing device according to claim 1, wherein the embossing impression cylinder includes a sheet holding device configured to hold the sheet and a first plate holding device configured to hold a first plate, and is a single-diameter impression cylinder including having an effective impression area corresponding to one sheet; and the plate cylinder includes a second plate holding device configured to hold a second plate, is configured to be able to contact and separate from the single-diameter impression cylinder, and is a single-diameter plate cylinder having an effective impression area corresponding to one sheet.

3. The processing device according to claim 2, wherein the first plate holding device and the second plate holding device are capable of holding both an intaglio printing plate and a relief printing plate.

* * * * *